United States Patent [19]

Hagedorn

[11] 3,941,236

[45] Mar. 2, 1976

[54] INFEED APPARATUS FOR CARTON LOADING MACHINES

[76] Inventor: Hans Hagedorn, 947 Huntington Crescent, North Vancouver, British Columbia, Canada

[22] Filed: Dec. 13, 1973

[21] Appl. No.: 426,716

[52] U.S. Cl. ..... 198/29; 53/164

[51] Int. Cl.[2] ..... B65G 47/22

[58] Field of Search..... 198/29, 20, 35, 22 B, 168, 198/19, 30, 202, 221; 53/62, 159, 164

[56] References Cited

UNITED STATES PATENTS

| | | | |
|---|---|---|---|
| 3,060,659 | 10/1962 | Blais et al. | 53/164 X |
| 3,082,584 | 3/1963 | Schmid | 53/164 X |
| 3,473,289 | 10/1969 | Vadas | 53/164 X |
| 3,594,977 | 7/1971 | Grasvoll | 53/162 |
| 3,807,128 | 4/1974 | Bauer | 53/159 |

*Primary Examiner*—Evon C. Blunk
*Assistant Examiner*—James M. Slattery
*Attorney, Agent, or Firm*—Larson, Taylor and Hinds

[57] ABSTRACT

Apparatus for assembling predetermined numbers of containers into groups, and then successively shifting the groups into a machine where they are loaded in cartons. The apparatus can simultaneously assemble two groups of containers, and superimpose one group upon the other before the two groups are simultaneously moved into the loading machine.

19 Claims, 12 Drawing Figures

Figure 1:
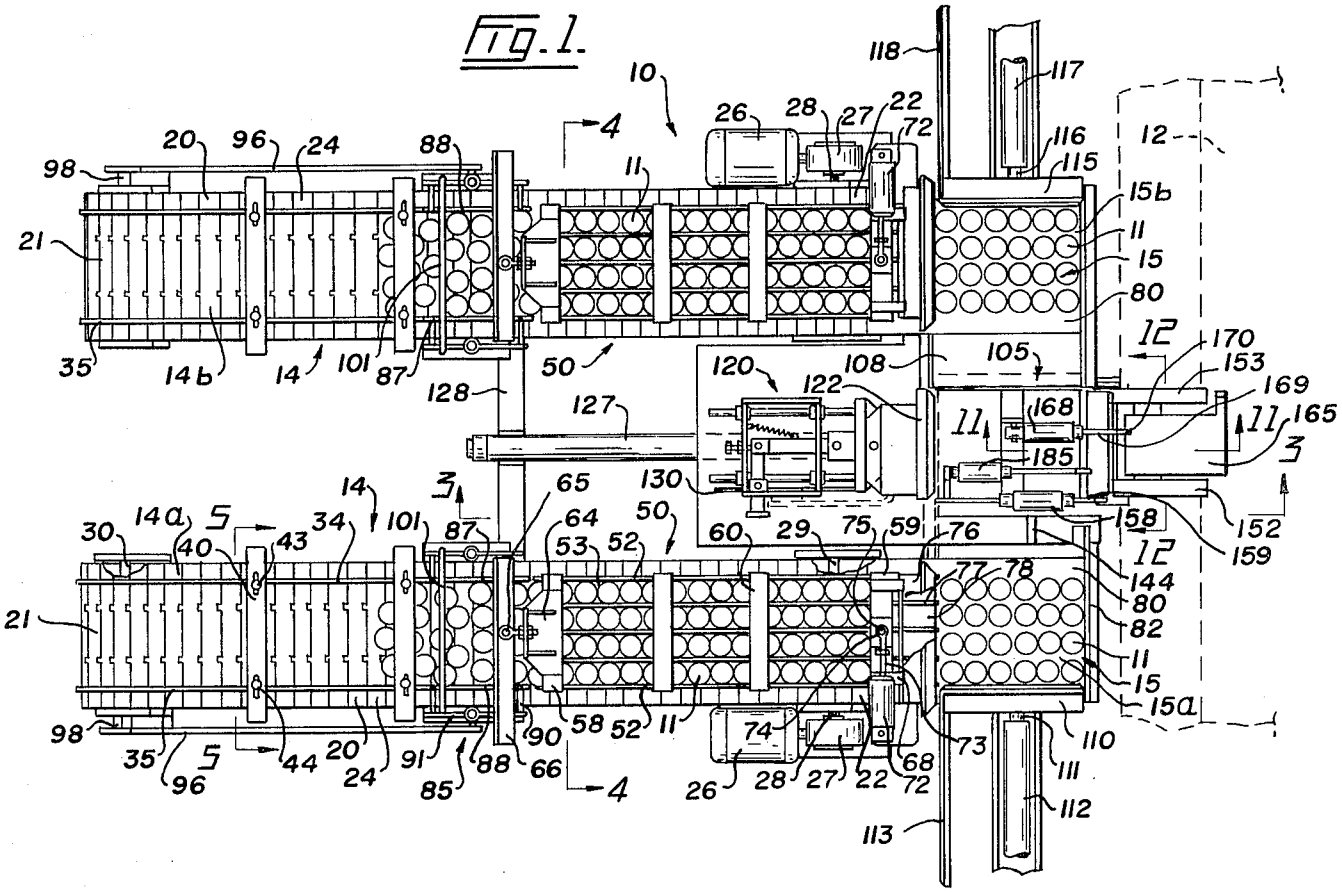

FIG. 6.
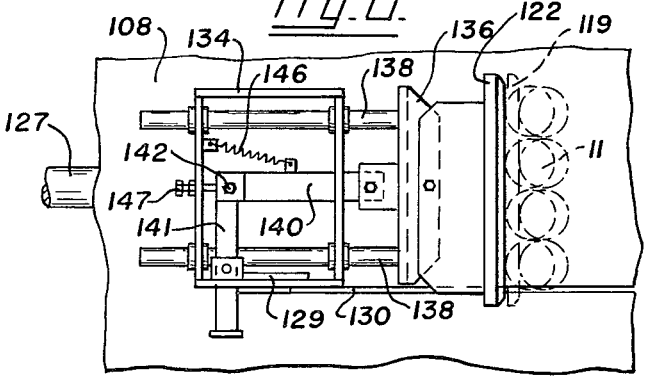
FIG. 7.
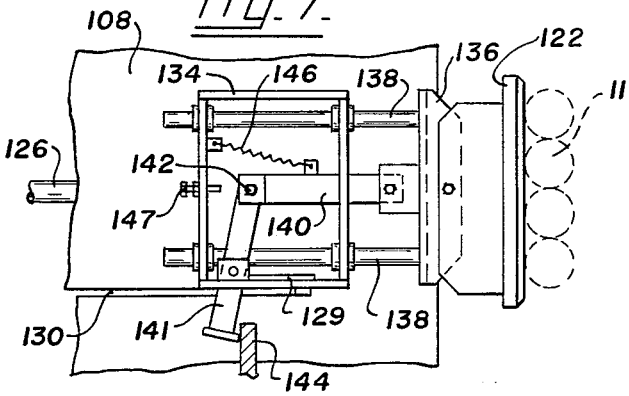
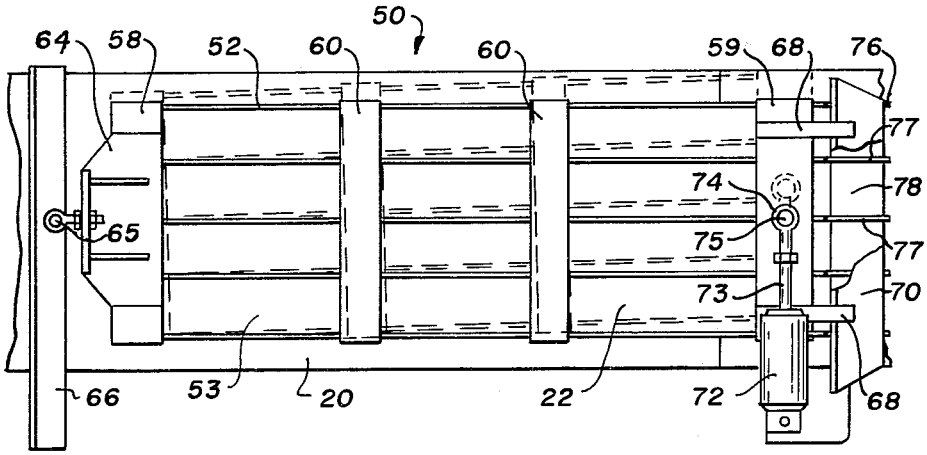
FIG. 9.

INFEED APPARATUS FOR CARTON LOADING MACHINES

This invention relates to infeed apparatus for automatically assembling containers into groups and then moving the groups into carton loading machines.

Although the present apparatus is designed for feeding several different types of containers, it is particularly designed for cylindrical containers, commonly called "cans."

The cylindrical shape of cans have made them rather difficult to assemble into groups to be moved as groups into apparatus wherein they are inserted into open-ended cases or cartons or are positioned on carton blanks which are then wrapped around the groups. The cans or containers are continuously received from conveyors, and they have to be moved successively and assembled into groups. This means that the containers are sometimes stopped in infeed apparatus.

It has been found difficult to stop and start conveyors in infeed apparatus which slows down the operation of the apparatus and creates problems of wear and maintenance. The cans have to be lined up in the groups, and it is difficult to keep the cans properly aligned until they are moved into the carton machine.

The present invention reduces or eliminates these problems by providing apparatus having at least one continuously moving infeed conveyor. This conveyor moves the containers into a guide divided into a plurality of open-ended channels extending longitudinally of the conveyor. Means is provided for jiggling the cans as they are about to move into the guide channels in order to prevent blockage in this area. As the containers are fed into one end of the guide channels, containers are moved out of the opposite ends thereof onto a platform in rows. When a predetermined number of containers are on this platform, forming a desired group, the guide is shifted so as to lock the containers in position on the platform. From here the containers are shifted in a group into a carton loading machine. During this shifting movement, the group is maintained within guides.

With this arrangement, the infeed conveyor moves continuously, the containers are assembled into a group and locked into this group, and then are moved into the carton loading machine.

In a preferred form of this infeed apparatus, two groups of containers are simultaneously formed in the manner described above. After the two groups have been assembled, one is moved beneath a supporting plate and the other is moved on top of this plate. Following this, the two groups are moved away from the plate into the carton loading machine, the containers of the top group resting on those of the bottom group as the containers leave the supporting plate.

Infeed apparatus in accordance with the present invention comprises an endless conveyor having a receiver end for receiving containers to be loaded in cartons and a discharge end, a guide overlying the conveyor at the discharge end thereof, said guide being divided into a plurality of open-ended channels extending longitudinally of the conveyor for receiving containers moved by the conveyor and arranging said containers in rows, a platform at the discharge end of the conveyor and positioned to receive rows of containers from the conveyor, and stop means above the platform and spaced a distance from the conveyor to be engaged by containers when a predetermined member of containers in the rows are moved on to the platform.

In an alternative form of the invention, the infeed apparatus comprises first and second endless conveyors each having a receiver end for receiving containers to be loaded into cartons and a discharge end, said second conveyor being on a higher level than the first conveyor, a guide overlying each conveyor at the discharge end thereof, each guide being divided into a plurality of open-ended channels extending longitudinally of its conveyor for receiving containers moved by the latter and arranging said containers into rows, a platform at the discharge end of each conveyor and positioned to receive rows of containers from its conveyor, the platform of the second conveyor being higher than the platform of the first conveyor, and stop means above each platform and spaced a distance from its conveyor to be engaged by containers when a predetermined member of containers in the rows are moved on to the platform.

Figure 2:
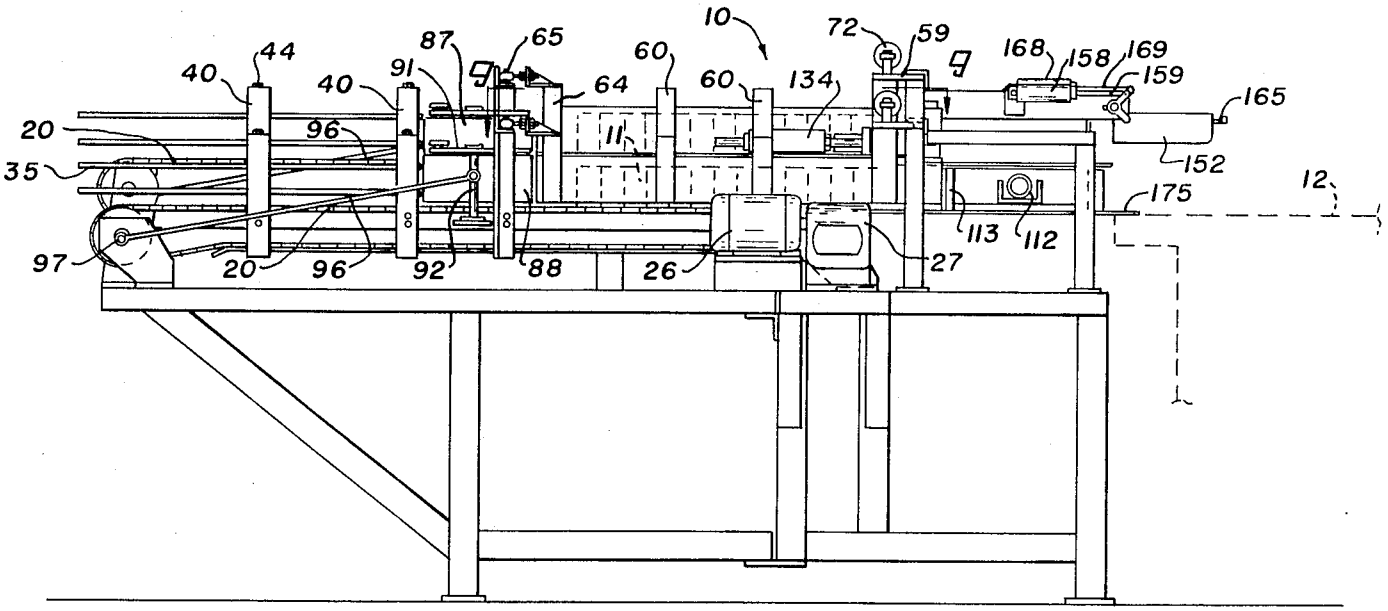
Figure 3:
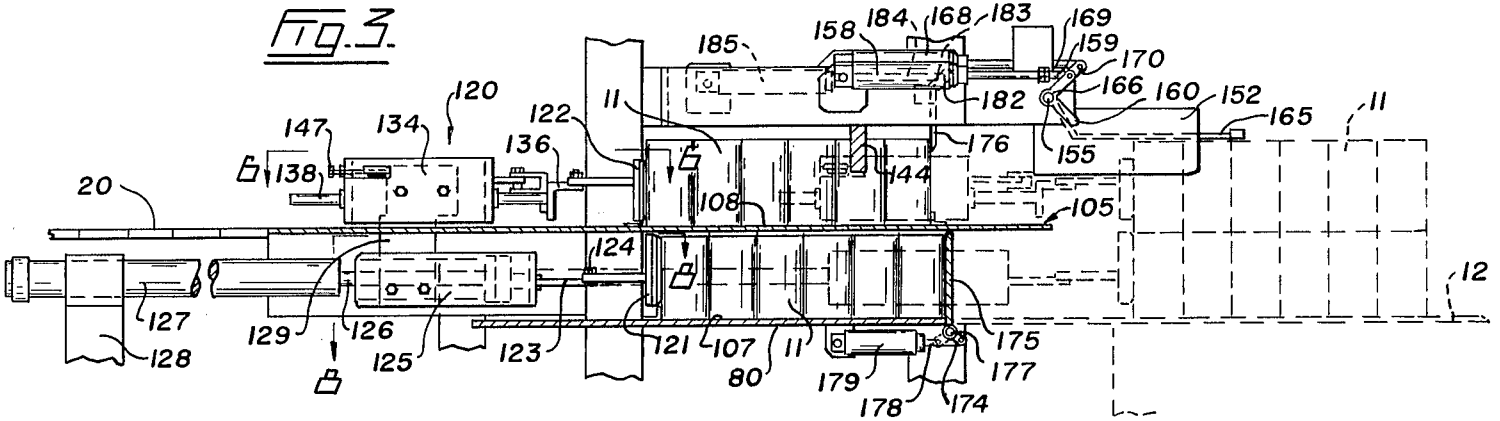
Figure 4:
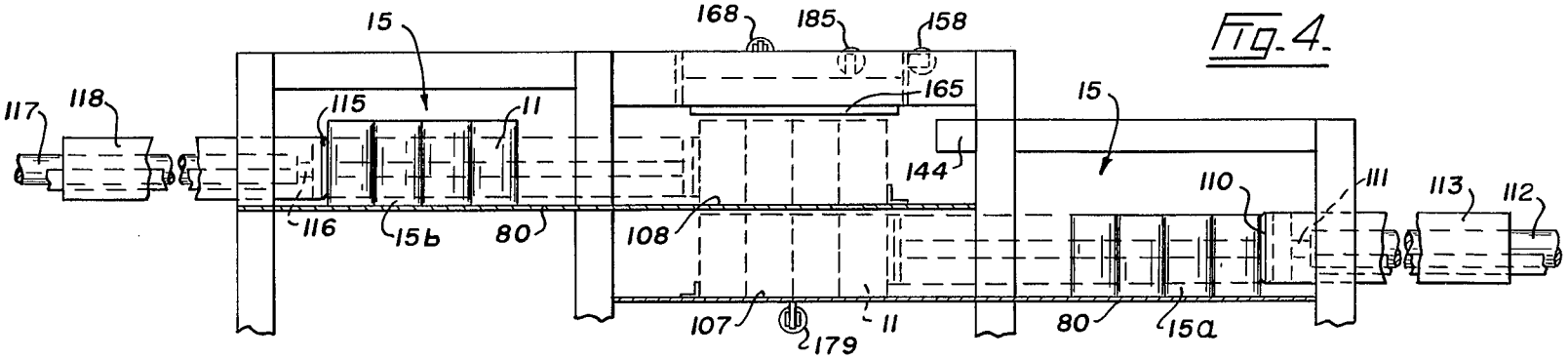
Figure 5:
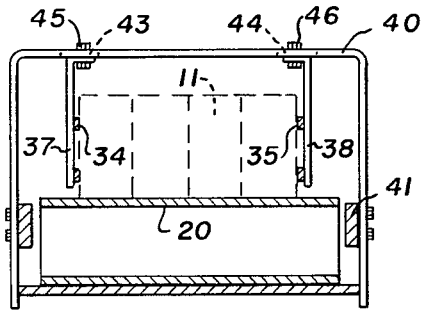
Figure 8:
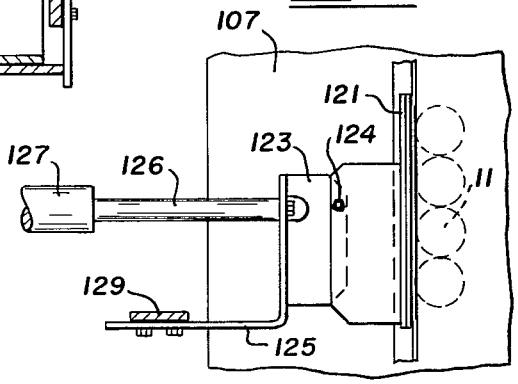
Figure 10:
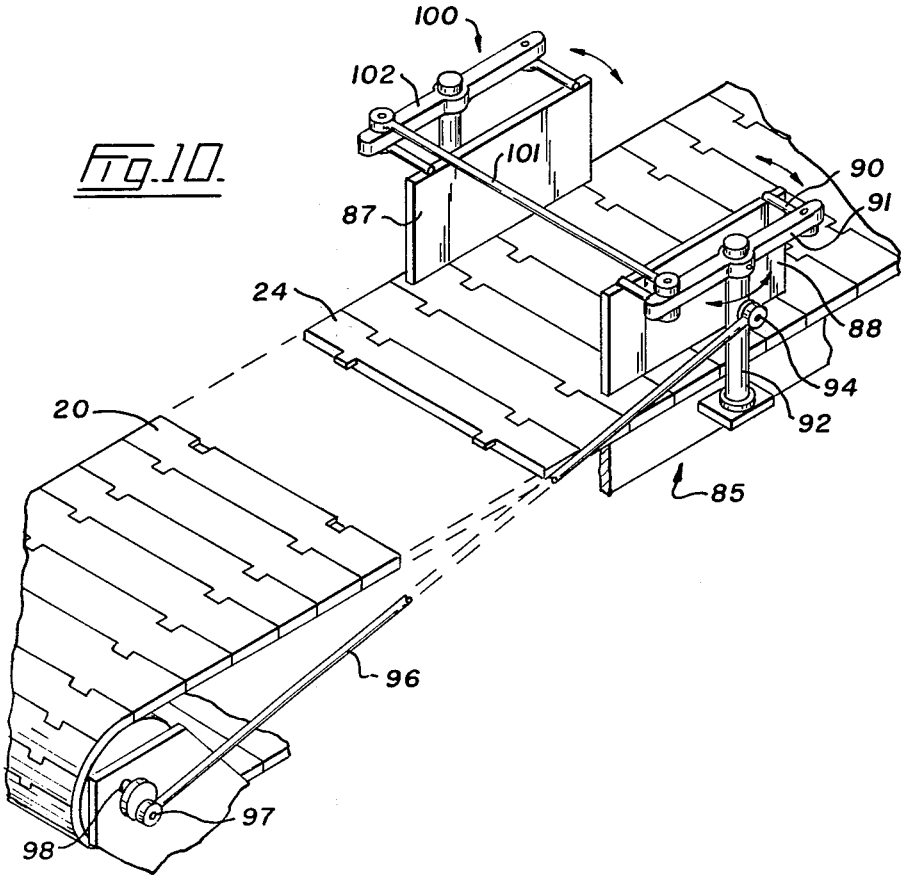
Figure 11:
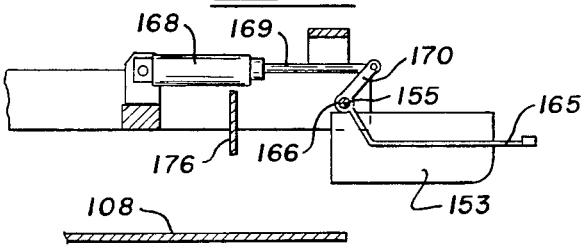
Figure 12:
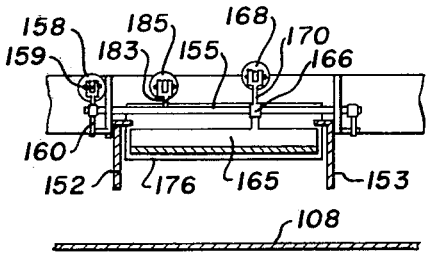

A preferred form of infeed apparatus according to this invention is illustrated in the accompanying drawings, in which FIG. 1 is a plan view of the apparatus, FIG. 2 is a side elevation of the apparatus, FIG. 3 is an enlarged fragmentary sectional view taken on the line 3—3 of FIG. 1, FIG. 4 is an enlarged cross-sectional view taken on the line 4—4 of FIG. 1, FIG. 5 is an enlarged section taken on the line 5—5 of FIG. 1, FIG. 6 is a fragmentary sectional view taken on the line 6—6 of FIG. 3, showing a portion of the apparatus in its normal position, FIG. 7 is a view similar to FIG. 6, but showing this portion of the apparatus in an operating position, FIG. 8 is a horizontal section taken on the line 8—8 of FIG. 3, FIG. 9 is an enlarged sectional view taken on the line 9—9 of FIG. 2, showing one of the guides in plan view, FIG. 10 is an enlarged fragmentary perspective view of container jiggling apparatus over a conveyor belt, the adjacent container guide being omitted for the sake of clarity, FIG. 11 is an enlarged longitudinal section taken on the line 11—11 of FIG. 1, and FIG. 12 is an enlarged cross section taken on the line 12—12 of FIG. 1.

Referring to the drawings, 10 is infeed apparatus in accordance with this invention which is adapted to assemble containers or cans 11 and to direct them into a carton loading machine 12, a portion of which is indicated in broken lines in FIGS. 1 and 2. Apparatus 10 includes a feeding section 14 and an assembling section 15. In the illustrated form of the invention, there are actually two feeding-assembling sections located side by side, and as these are identical, only one will be described in detail.

Feeding section 14 includes an endless conveyor 20 having a receiver end 21 and a discharge end 22. This conveyor is a well-known type and is made up of a plurality of hingedly connected slats 24 which provide a flat almost unbroken surface in the upper horizontal run of the conveyor. Conveyor 20 is driven at one end by an electric motor 26 through a reduction gear box 27. A drive shaft 28 is connected to a roller 29 around which the adjacent end of the conveyor travels, the opposite ends of this conveyor travelling around another roller 30.

A pair of guide walls 34 and 35 are mounted above conveyor 20 and extend from its outer or receiver end 21 part way towards its opposite end. Either or both of these guide walls is or are adjustable laterally relative to the conveyor. In this example, both walls are adjustable. Walls 34 and 35 are respectively carried by vertical supports 37 and 38, see FIG. 5, which are suspended from yokes 40 which span conveyor 20 and are mounted on a suitable base 41 below the conveyor. Each yoke 40 has slots 43 and 44 in the top portion thereof through which bolts 45 and 46 extend. These bolts also extend through the upper ends of vertical supports 37 and 38 adjustably to secure these supports to the yoke.

A guide 50 overlies conveyor 20 at the discharge end 22 thereof and extends towards the guide walls 34 and 35. This guide is made up of a plurality of laterally spaced partitions 52 which form open-ended channels 53 therebetween. Each of these channels is just slightly wider than the diameter of the containers or cans 11 which apparatus 10 is designed to handle. If containers of different sizes are to be handled, guide 50 is changed for one that has channels of sufficient width to permit these containers to move therethrough.

Partitions 52 are retained in their respective positions by yokes 58 and 59 at their opposite ends and one or more intermediate yokes 60 between said ends. It will be noted in FIG. 1 that the outermost partitions 52 of guide 50 are aligned with guide walls 34 and 35.

It is preferable to mount guide 50 so that its yoke end 59 can be shifted back and forth transversely of the conveyor. For this purpose, an eye bolt is secured to yoke 58 through a mounting bracket 64, and fits over a pin 65 projecting upwardly from a bridge 66 which spans conveyor 20. The opposite end of guide 50 is supported by lugs 68 which are secured to yoke 59 and project outwardly therefrom and rest on the top of another bridge 70. A fluid cylinder 72 mounted near and to one side of end 22 of the conveyor has a piston rod 73 which extends inwardly over yoke 59 and has an eye 74 at its outer end fitting over a pin 75 projecting upwardly from said yoke. Normally, guide 50 is aligned exactly with guide walls 34 and 35, but cylinder 72 can be operated to shift the adjacent end of the guide laterally slightly relative to said guide walls, the guide swinging on pin 65 at this time, see FIG. 9.

It is preferable to provide a stationary guide section 76 at and aligned with the inner end of guide 50, see FIG. 1. This guide section has partitions 77 with channels 78 therebetween normally aligned with partitions 52 and channels 53 of guide 50.

A smooth surfaced receiving platform 80 is located just clear of the discharge end 22 of conveyor 20 and beneath guide section 76 and the adjacent end of guide 50, the surface of this plate being in the same plane as the upper surface of the conveyor. A wall or stop 82 is adjustably mounted above and projects upwardly from platform 80 at a predetermined distance from the ends of guide partitions 77. The distance between stop 82 and the guide partitions 77 determines the number of containers 11 that can be moved on to platform 80 at one time. In this example, there are four channels 53 and 78 in the guide and the stationary guide section, respectively, and this forms four rows of the container. The distance between stop 82 and the end of the guide partitions is sufficient to accommodate six containers on platform 80 aligned with each channel 53, 78. This means that a group of 24 containers is formed on platform 80. When the required number of containers are on the platform, cylinder 72 is operated to shift the adjacent end of guide 50 laterally a little. This shifts partitions 52 out of line with partitions 77 so that containers cannot move into or out of channels 78 or off platform 80. In other words, the containers on platform 80 are locked thereon.

Although guide walls 34 and 35 may extend right up to the end of guide 50, it is preferable to provide vibratory means 85 therebetween, see FIGS. 1 and 10. This vibratory means consists of a pair fo vertical side plates 87 and 88 which are spaced apart the same distance as guide walls 34 and 35 and the outermost partitions 52 of the guide, and are aligned therewith, as shown in FIG. 1. Plate 88 is carried by arms 90 which project inwardly from a crossbar 91 which is fixed to a rotatably mounted vertical shaft 92. A pin 94 projects outwardly from shaft 92 and is connected through a sloppy fit to one end of a long link 96, the opposite end of which is connected to an eccentric cam 97 mounted on a shaft 98 which projects from roller 30 of conveyor 20. When the conveyor is operating, cam 97 jiggles bar 91 which, in turn, jiggles plate 88. Side plate 87 is mounted in the same manner through mounting means 100 as plate 88, but plate 87 is jiggled by a link 101 connected to cross bar 91 and to a crossbar 102 of mounting means 100, see FIG. 10. Thus, during operation, cam 97 swings side plates 87 and 88 back and forth to jiggle the containers therebetween as said containers are moved by conveyor 20 towards the adjacent end of guide 50. This prevents any of the containers from hanging up against the ends of partitions 52 of the guide.

As stated above, there are two parallel feeding-assembly sections 14, 15, and for convenience one set of sections has been labelled **14*a*, 15*a*, while the other has been labelled 14*b*, 15*b*. When there are two assembly sections, the platform 80 of one is located below the level of the platform of the other. In this example, the platform of section 15*a* is below the level of platform 80 of section 15*b*. The distance between these two levels is just a little more than the height of containers 11**.

A double-tiered feed support or platform 105 is located between the platforms 80 of sections **15*a* and 15*b*. Support or platform 105 consists of a lower plate or tier 107 aligned with and in the same plane as platform 80 of section 15*a*, and an upper plate or tier 108 aligned with an in the same plane as platform 80 of section 15*b*. Suitable means is provided for shifting the group of containers 11 on each of these platforms laterally on to the respectively aligned plates of support 105. In this example, a head 110 is mounted on the end of a piston rod 111 projecting from a fluid cylinder 112. An elongated stop 113 is secured to one end of head 110 and projects rearwardly and outwardly therefrom, as shown in FIG. 1. When piston rod 111 is retracted, head 110 is aligned with the adjacent outer partition 52 of guide 50, and acts as a confining wall for the containers on platform 80. Similarly, another head 115 is provided for platform 80 of section 15*b*, the latter head being mounted on the end of a piston rod 116 of a fluid cylinder 117. An elongated stop 118 is mounted on and projects rearwardly from an end of head 115. This head performs in the same manner and serves the same purpose as head 110. With this arrangement, when cylinders 112 and 117 are operated, the group of containers on the adjacent platforms 80 are shifted laterally inwardly of the apparatus, the containers of section 15***a* being moved on to the lower plate 107 and the containers of section 15*b* being moved on to the upper plate 108 of support 105. The container groups are now position one above the other and are aligned with the entrance, not shown, of carton apparatus 12. As the heads 110 and 115 move inwardly of the apparatus, their respective stops 113 and 118 close off the adjacent ends of passages 78 of guide section 76.

Suitable means is provided for moving the container groups off their respective support plates and into the carton loading machine, and this means is best seen in FIGS. 1, 3, 6, 7 and 8. Although the upper and lower containers may be exactly aligned and moved in this alignment into the loading machine, it is preferable to move one group slightly ahead of the other group so that the containers are out of alignment as they are moved into the loading machine. In the latter case, means is provided for moving the containers into alignment within the loading machine. The reason for this preference is that it is very difficult to get the containers exactly aligned and to hold them in that alignment as they are moved into the machine. If a container gets out of alignment during the movement, it is very likely to fall over or to move others out of position. On the other hand, if the containers are staggered a little, each of the upper containers rests on portions of two containers below it and this is a better support than when the containers are supposed to be aligned and one shifts slightly out of alignment with the other.

Shifter apparatus 120 is provided between the two feeding sections 14 for this purpose. This apparatus has lower and upper substantially aligned heads 121 and 122, see FIGS. 3, 6, 7 and 8. Lower head 121 is releasably secured to a bracket 123 by a bolt 124, said bracket being carried by a frame 125. Bracket 123 is secured to and carried by the outer end of a piston rod 126 which projects from a long fluid cylinder 127 which, in turn, is carried by a bracket 128, see FIGS. 1 and 3.

An arm 129 is secured to frame 125 and extends upwardly therefrom through a long slot 130 in the portion of upper plate 108 which extends outwardly from assembly section 15, see FIG. 3. This arm is connected at its upper end to one side of a rectangular frame 134, as shown in FIGS. 6 and 7. Upper head 122 is secured to a bracket 136 which is connected to the ends of a pair of rods 138 which slidably extend through portions of frame 134, see FIGS. 6 and 7. A central rod 140 is connected to bracket 136 between the two rods 138 and slidably extends through a portion of frame 134 and is pivotally connected to a lever 141 which is swingably mounted on a pin 142 carried by a side of frame 134. The outer end of lever 141 projects laterally from this frame in line with a stop 144 which projects downwardly into the path of this lever, see FIGS. 3 and 7. A spring 146 connected at one end thereof to rod 140 and at its opposite end to frame 134, see FIGS. 6 and 7, normally holds the inner end of this rod against an adjustable set screw 147.

By referring to FIG. 3, it will be seen that upper pusher head 122 is normally spaced a little rearwardly of lower head 121, as shown in full lines in this Figure. When cylinder 127 is activated, piston rod 126, which is connected to lower frame 125, moves said lower frame and upper frame 134 forwardly in the direction of the carton loading machine 12, the upper frame being moved by the lower frame through vertical arm 129. When the outer end of lever 141 engages stop 144, the lever swings around pin 142 so that upper head 122 is moved forwardly into line with lower head 121, as shown in dotted lines in FIG. 3. When piston rod 126 is moved in the opposite direction, the upper and lower heads are returned to their normal positions, during which time lever 141 clears stop 144, allowing spring 146 to return the upper head to its position out of line with the lower head.

During the forward movement of pusher heads 121 and 122, the containers 11 grouped on lower plate 107 and upper plate 108 are moved forwardly and into loading machine 12, the two heads 110 of the assembly sections 15*a* and 15*b* being in their innermost positions at this time and acting as side guides for the containers. During this time, the upper containers are moved off plate 108 and rest on the upper ends of the containers sliding on the lower plate 107. As pusher head 122 is behind pusher head 121, the upper containers rest on parts of two lower containers so that they remain quite steady during this movement. By the time that head reaches its outermost position, lever 141 has engaged stop 144 to move upper head 122 forwardly relative to the lower head, and this shifts the upper containers into alignment with the lower containers within the loading machine. The latter machine has stops for these containers.

It is desirable to provide guide means for the containers at the time the upper containers leave plate 108 to sit on the lower containers.

A pair of transversely-spaced vertical side plates 152 and 153, see FIGS. 11 and 12, are fixedly mounted at one end on a transverse shaft 155 and extend forwardly therefrom into loading machine 12. These plates may be swung upwardly out of the loading machine by means of a fluid cylinder 158 having a piston rod 159 extending therefrom and connected at its outer end to the crank 160 which is fixedly connected to and projects upwardly from shaft 155. Retraction of piston rod 159 rotates shaft 155 to swing the side plates 152 and 153 upwardly out of the way.

A stabilizer plate 165 is connected to a sleeve 166 which is rotatably mounted on shaft 155 and projects forwardly therefrom between side plates 152 and 153 near the upper edges thereof. This stabilizer plate is slightly springy, and it can be swung upwardly out of the loading machine by a fluid cylinder 168 having a piston rod 169 projecting therefrom, the outer end of said rod being connected to a lug 170 secured to and projecting upwardly from sleeve 166. When piston rod 169 is extended, plate 165 is in its normal or operative position, and when the piston rod is retracted, this plate is swung upwardly out of the way.

When the two groups of containers are being moved by pusher heads 121 and 122 into the loading machine, the upper containers move between vertical side plates 152 and 153 and beneath stabilizer plate 165 which is inclined slightly downwardly so that the uppermost containers brush against this plate. The resiliency of plate 165 causes the latter to exert a downward pressure on the containers as they are being moved into the machine, thereby helping to stabilize these containers at this time.

Retractable stops are provided above lower plate 107 and above upper plate 108, these stops being spaced respectively from pusher heads 121 and 122 so that they act as side guides opposed to these heads when the containers are being moved into the superimposed position by the two pusher heads 110.

These stops are in the form of hingedly-mounted vertical plates 175 and 176, see FIG. 3. Plate 175 is fixedly mounted at its lower edge on a horizontal shaft 174, which is rotated through a lug 177 by the piston rod 178 of a fluid cylinder 179. When piston rod 178 is extended, stop plate 175 is in a vertical position as shown in full lines in FIG. 3, and when the piston rod is retracted, the stop plate is swung into the horizontal position at the level of plate 107 and forms an extension of the latter as shown in broken lines in FIG. 3. Similarly, upper stop plate 176 is fixedly connected at its upper edge to a rotatable horizontal shaft 182, and a lug 183 fixed to this shaft and projecting upwardly therefrom is connected to the outer end of a piston rod 184 of a fluid cylinder 185. When piston rod 184 is extended, stop plate 176 hangs downwardly in a vertical position, and when this piston rod is retracted, the plate is swung upwardly into a horizontal position.

The operation of feeding apparatus 10 is relatively simple. The containers or cans to be loaded into cartons are directed on to the receiver ends 21 of the two continuously operating conveyors 20. As these cans or containers are moved forwardly by the conveyors, they pass between side plates 87 and 88 of vibratory means 85 where they are subjected to a jiggling action as they are moved forwardly into the channels 53 of guides 50. The partitions 52 of the guides form the containers into rows, and the conveyors move these containers forwardly through channels 78 of guide section 76 and on to platforms 80 of assembly sections 15*a* and 15*b*, the platform of the latter being higher than that of the former. When the containers engage stop walls 82, they at the same time touch contact switches, not shown, which cause the two cylinders 72 to be actuated to shift the ends 70 of the two guides 50 towards each other so that the partitions 52 thereof lock the containers in channels 78 and on the platforms. As the upper surfaces of conveyors 20 are quite smooth, the containers in guides 50 stop moving at this time, even though the conveyors continue to operate. Next, the two pusher heads 110 are moved by their respective cylinders 112 inwardly of the apparatus to shift the assembled containers on to the lower and upper plates 107 and 108 of the double-tiered feed support 105. During this lateral movement of the containers, the stop plates 175 and 176 are in their vertical positions so that the containers are confined during this movement between these stop plates and the pusher heads 121 and 122. The stops 113 and 118 of heads 110 trap the containers in channels 78 of guide section 76.

When the containers are in the proper positions, pusher heads 110 are stopped, and cylinders 178 and 185 are energized to swing stop plates 175 and 176 into horizontal positions out of the way. Then cylinder 127 is energized to move the upper and lower pusher heads 121 and 122 to shift the containers into the loading machine 12. As the upper containers leave plate 108 they drop onto the upper ends of the lower containers but are staggered relative thereto, but when lever 141 engages stop 144, upper head 122 advances relative to lower head 121 to shift the containers into vertical alignment within the carton loading machine. Side plates 152 and 153 and stabilizer plate 165 are swung upwardly out of machine 12 by cylinders 158 and 168 so that the loading machine can do its job after heads 121 and 122 are withdrawn therefrom. When these heads reach their normal at-rest position, the remaining elements of apparatus 10 are returned to their normal at-rest positions. As heads 110 are retracted, the ends 70 of guides 50 are shifted back to their normal positions so that containers are now moved by conveyors 20 into channels 78 of guide section 76 and on to the platforms 80. As conveyors 20 terminate short of these platforms, the containers on the conveyors move those ahead of them through channels 78 and on to and across the platforms 80 until a container of each of the four rows thereof engages stop wall 82.

Apparatus 10 can be used to feed only single layers of containers. In this case, only feeding and assembling section 15*a* would be operated.

I claim:

1. Apparatus for grouping containers and feeding the groups to a carton loading machine, comprising a smooth-surfaced endless conveyor having a receiver end for receiving containers to be loaded into cartons and a discharge end, a platform at the discharge end of the conveyor and positioned to receive containers therefrom, a guide overlying the conveyor at the discharge end thereof, said guide being divided by a plurality of laterally spaced partitions into a plurality of open-ended channels extending longitudinally of the conveyor and terminating in inner ends near said platform, a stationary guide section overlying said conveyor between said guide and said platform, said guide section including a plurality of spaced partitions forming open-ended channels normally aligned with the partitions and channels, respectively, of said guide, means for pivotably supporting said partitions of said guide so that the inner ends thereof can be shifted laterally out of alignment with the partitions of said guide section, said conveyor moving containers successively into and through the channels and on to and across the platform in rows, stop means above the platform and spaced a distance from the conveyor and said guide partitions to be engaged by containers when a predetermined number of containers in the rows are moved on to the platform, power means connected to the guide partition inner ends for shifting said ends laterally into positions opposite the adjacent ends of the rows of containers on the platform, and operating means at said stop means and operatively connected to said power means and operated by containers at the stop means to cause the power means to laterally shift the inner ends of the partitions of the guide out of alignment with the partitions of the guide section when said predetermined number of containers are on the platform so as to lock the containers on the platform.

2. Apparatus as claimed in claim 1 including vibratory means for jiggling the containers on the conveyor at outer ends of said partitions to prevent said containers from being caught on said outer ends.

3. Apparatus as claimed in claim 1 in which said platform has a smooth uninterrupted surface, and including a feed support on one side of the platform to receive containers therefrom, and means for shifting the rows of containers transversely of said rows on the platform in a group laterally off said platform and on to the feed support.

4. Apparatus as claimed in claim 3 including means for shifting the group of containers off said feed support and into an adjacent carton loading machine.

5. Apparatus as claimed in claim 3 in which said means for shifting the rows of containers in a group comprises a pusher head normally positioned on the side of the platform remote from said feed support and mounted for movement back and forth across the platform, and power means for reciprocating the pusher head across the platform.

6. Apparatus as claimed in claim 5 including stop means connected to the pusher head so as to move across the inner ends of the guide partitions to close off the channels therebetween when said head is reciprocated across the platform.

7. Apparatus for grouping containers and feeding the groups to carton loading machines, comprising first and second feeding sections, each said feeding section comprising a smooth-surfaced endless conveyor having a receiver end for receiving containers to be loaded into cartons and a discharge end, a platform at the discharge end of the conveyor and positioned to receive containers therefrom, a guide overlying the conveyor at the discharge end thereof, said guide being divided by a plurality of laterally spaced partitions into a plurality of open-ended channels extending longitudinally of the conveyor and terminating in inner ends near said platform, a stationary guide section overlying said conveyor between said guide and said platform, said guide section including a plurality of spaced partitions forming open-ended channels normally aligned with the partitions and channels, respectively, of said guide, means for pivotably supporting said partitions of said guide so that the inner ends thereof can be shifted laterally out of alignment with the partitions of said guide section, said conveyor moving containers successively into and through the channels and on to and across the platform in rows, stop means above the platform and spaced a distance from the conveyor and said guide partitions to be engaged by containers when a predetermined number of containers in the rows are moved on to the platform, power means connected to the guide partition inner ends for shifting said ends laterally into positions opposite the adjacent ends of the rows of containers on the platform, and operating means at said stop means and operatively connected to said power means and operated by containers at the stop means to cause the power means to laterally shift the inner ends of the partitions of the guide out of alignment with the partitions of the guide section when said predetermined number of containers are on the platform so as to lock the containers on the platform, the conveyor and platform of the first feeding section being higher than the conveyor and platform of the second feeding section.

8. Apparatus as claimed in claim 7 including vibratory means for jiggling the containers on the conveyor at the outer ends of the partitions of each guide to prevent said containers from being caught on said outer ends.

9. Apparatus as claimed in claim 7 in which each of said platforms has a smooth uninterrupted surface, and including a double-tiered feed support between said platforms, said feed support having a lower tier positioned to receive containers from the platform of the first feeding section and an upper tier positioned to receive containers from the platform of the second feeding section, and means for shifting the rows of containers transversely of said rows in a group off each of the platforms and on to the respective upper or lower tier of the feed support.

10. Apparatus as claimed in claim 9 in which said means for shifting the rows of containers in a group off each platform comprises a pusher head normally positioned on the side of the platform remote from said feed support and mounted for movement back and forth across the platform, and power means for reciprocating the pusher head across the platform.

11. Apparatus as claimed in claim 10 including stop means connected to each pusher head so as to move across the inner ends of the adjacent guide partitions to close off the channels therebetween when said head is reciprocated across the platform.

12. Apparatus as claimed in claim 9 including means for shifting the groups of containers simultaneously off the tiers of the feed support and into an adjacent loading machine, the containers of the lower tier supporting the containers of the upper tier as said containers leave the feed support.

13. Apparatus as claimed in claim 12 in which said means for simultaneously shifting the groups of containers comprises lower and upper pusher heads mounted for movement respectively over the lower and upper tiers, and power means for reciprocating said lower and upper heads across their respective tiers.

14. Apparatus as claimed in claim 13 in which said lower pusher head is positioned a little ahead of the upper pusher head with respect to the direction of movement thereof so that the containers of the upper tier are staggered a little relative to the containers of the lower tier as said containers are moved off their respective tiers.

15. Apparatus as claimed in claim 14 including means for advancing the upper pusher head into vertical alignment with the lower pusher head just before said heads stop moving in the direction of the loading machine.

16. Apparatus as claimed in claim 9 including guide means for the containers moving off the upper tier of the feed support.

17. Apparatus as claimed in claim 16 in which said guide means comprises a pair of spaced vertical guide plates mounted adjacent the upper tier to project into said loading machine and forming a pathway therebetween along which the containers of the upper tier move, and power means connected to said guide plates operable to move said guide plates up and out of the way.

18. Apparatus as claimed in claim 16 in which said guide means comprises a slightly springy horizontal stabilizer plate mounted adjacent the upper tier to project into said loading machine over a pathway along which the containers of the upper tier move, said stabilizer plate bearing down on said moving containers, and power means connected to said stabilizer plate operable to move said plate up and out of the way.

19. Apparatus as claimed in claim 16 in which said guide means comprises a pair of spaced vertical guide plates mounted adjacent the upper tier to project into said loading machine and forming a pathway therebetween along which the containers of the upper tier move, first power means connected to said guide plates operable to move said guide plates up and out of the way, a slightly springy horizontal stabilizer plate mounted adjacent the upper tier to project into said loading machine over said pathway, said stabilizer plate bearing down on said moving containers, and second power means connected to said stabilizer plate operable to move said plate up and out of the way.

* * * * *